US005579794A

United States Patent [19]

Sporta

[11] Patent Number: 5,579,794

[45] Date of Patent: Dec. 3, 1996

[54] APPARATUS AND METHOD FOR SECURING AN OBJECT AGAINST GALE-FORCE WINDS

[76] Inventor: Joseph Sporta, 7 Maple Crescent, Hillsburgh, Ontario N0B 1Z0, Canada

[21] Appl. No.: 322,763

[22] Filed: Oct. 13, 1994

Related U.S. Application Data

[63] Continuation-in-part of Ser. No. 95,006, Jul. 23, 1993, abandoned, which is a continuation-in-part of Ser. No. 41,498, Apr. 1, 1993, abandoned.

[51] Int. Cl.[6] ..... E04H 12/20

[52] U.S. Cl. ..... 135/88.01; 135/90; 135/115; 135/913; 52/DIG. 11; 52/3; 52/4; 52/23

[58] Field of Search ..... 135/88.01, 88.05, 135/88.1, 913, 90, 115; 52/3, 4, 23, DIG. 11, 155

[56] References Cited

U.S. PATENT DOCUMENTS

| | | | |
|---|---|---|---|
| 362,774 | 5/1887 | Nevison . | |
| 3,054,151 | 9/1962 | Shankland | 52/155 X |
| 3,242,623 | 3/1966 | Brisse . | |
| 3,335,531 | 8/1967 | Grimelii . | |
| 3,715,843 | 2/1973 | Ballinger | 52/3 |
| 3,744,192 | 7/1973 | Brunett . | |
| 3,747,288 | 7/1973 | Grimelii . | |
| 3,769,764 | 11/1973 | Young | 52/DIG. 11 X |
| 3,783,766 | 1/1974 | Boucher | 52/3 X |
| 3,848,367 | 11/1974 | Barnes | 52/23 X |
| 3,937,437 | 2/1976 | Stewart | 52/155 X |
| 3,949,527 | 4/1976 | Double et al. | 52/4 |
| 4,070,802 | 1/1978 | Odom . | |
| 4,122,637 | 10/1978 | Runge et al. . | |
| 4,148,162 | 4/1979 | Goodrich . | |
| 4,252,850 | 2/1981 | De Winter . | |
| 4,413,029 | 11/1983 | Handwerker | 52/3 X |
| 4,484,420 | 11/1984 | Stokes . | |
| 4,613,096 | 9/1986 | Pugh | 135/88.01 X |
| 4,897,970 | 2/1990 | Double et al. . | |
| 4,931,320 | 6/1990 | Leonard . | |
| 5,079,048 | 1/1992 | Anitole . | |
| 5,197,236 | 3/1993 | Calhoun et al. . | |
| 5,319,896 | 6/1994 | Winger | 52/DIG. 11 X |

*Primary Examiner*—Wynn E. Wood

*Attorney, Agent, or Firm*—Cushman, Darby & Cushman, L.L.P.

[57] ABSTRACT

Method for shielding, anchoring and containing an object such as a trailer or motor home in gale-force winds. A wind-permeable perforate sheet extends downwardly and outwardly from the top of the object or the roof of a home at an acute angle so as to surround a substantial portion of each of the sides with an inclined wind-permeable planar surface. The sheet is anchored to helical ground anchors via mechanical attachments which may also be used to tighten the sheet over the object or home. Apparatus for shielding, anchoring and containing an object such as a trailer or motor home in gale-force winds is also disclosed.

4 Claims, 7 Drawing Sheets

APPARATUS AND METHOD FOR SECURING AN OBJECT AGAINST GALE-FORCE WINDS

RELATED APPLICATIONS

This is a continuation-in-part of Ser. No. 08/095,006, filed Jul. 23, 1993, now abandoned, which is a continuation-in-part of Ser. No. 08/041,498, filed Apr. 1, 1993, now abandoned.

FIELD OF INVENTION

The present invention relates to an apparatus and a method for securing objects, particularly, mobile trailer and motor homes against gale-force winds, and more particularly to a containment and protective apparatus and method for securing such objects to the ground and protecting and containing them in gale-force winds.

BACKGROUND OF THE INVENTION

Objects such as aircraft, small sail and motor boats, vehicles and particularly, trailer and motor homes, due to their light construction, large surface area and relatively low mass, are highly susceptible to damage and destruction from gale-force winds. Notably, gale-force winds have commonly been known to overturn such objects, or worse yet, lift and/or blow them a distance, resulting in severe damage and sometimes complete destruction of the object.

Aircraft are typically anchored to the ground by lines, straps, chains and the like to specific parts associated with the wheels or struts of the aircraft.

Objects such as small watercraft, power and sail boats, typically, rest on cradles or blocks formed of wood or steel when stored on land or are merely restrained by lines secured to an adjacent dockside or buoy when afloat. No other restraining means to prevent the boat from being hurled inland in the event of gale-force winds are employed.

Buildings, including residential homes and commercial and retail properties which typically rest on the ground by means of concrete footings and the like are often damaged by gale-force winds. In particular, roofs of buildings may be blown away. Further, the above objects are often damaged by flying debris created by the gale-force winds. Yet further, glasshouses for example, commercial greenhouses, are very susceptible to damage from windborne debris.

Vehicles are also often flung into the air and damaged by such winds.

Although netting has been used to embrace objects such as vehicles and aircraft, particularly as a means of carrying camouflage material, such netting has not been provided over the object as a secure retaining means sufficient to withstand gale-force winds and/or impact from flying debris.

Numerous prior art apparatus exist for securing mobile or trailer homes to the ground in the event of hurricane, flood, or gale-force winds. The majority of these prior art apparatus use a combination or anchor means, elongate strap members and tightening turnbuckles, whereby such strap members are placed over and encircle a mobile home and are affixed to anchor means via turnbuckles to anchor the mobile home to the ground.

U.S. Pat. Nos. 4,148,162, 4,070,802, 3,054,151, 3,335,531, 3,644,192, 3,747,288, 3,848,367 and 3,937,437 are all examples of such apparatus which secure a mobile home to the ground via elongate strap members placed over and encircling the mobile home.

For example, U.S. Pat. No. 3,054,151 and 4,070,802 each disclose "elongate metallic web-like hold-down straps 12 and 14" (U.S. Pat. No. '802) or "lashings 15" which bridge the roof of the mobile home and are secured at their ends to anchors.

Indeed, in some states within the United States of America where the incidence of hurricanes is high, such as in the State of Florida, State legislation requires that mobile homes be anchored to the ground in a stipulated manner requiring utilization of one or more of the above prior art apparatus and methods for securing mobile homes to the ground.

The above prior art apparatus, however, are often unsuccessful in preventing damage to mobile homes and small boats due to gale-force winds, since they completely fail to protect these objects from another source of damage, namely, damage due to impact with airborne debris, such as uprooted trees, bricks, flotsam, and the like which may impact the object at high velocity during a hurricane. For example, despite the utilization of such prior art apparatus, such prior art apparatus was unable to prevent the extensive damage and destruction to mobile homes which occurred in the state of Florida due to Hurricane Andrew in August of 1992. During this hurricane, trailer homes, despite being secured to the ground by prior art apparatus, suffered mass destruction due to being impacted by airborne projectiles such as trees, bricks, debris and the like, which so damaged trailer homes that the elongate strap members were completely ineffective in providing containment of the damaged trailer home. This often, and generally without exception, resulted in the damaged trailer home and its contents being completely blown away.

Accordingly, prior art apparatus do nothing to shield a mobile home from bombardment by airborne debris which frequently impacts a trailer home with such force so as to cause the break-up and disintegration of the mobile home. This is extremely undesirable, not only because of the destruction of the subject mobile home, but also because the resultant debris from the destroyed mobile home, including the mobile home's contents such as TV's, appliances, and the like, further add to the airborne debris circulating in a hurricane and in turn become airborne and impact and bombard other mobile homes, causing further resultant damage and destruction. Accordingly, the elongate strap members utilized with the apparatus of the aforementioned patents not only do nothing to shield a trailer home from airborne bombardment, but they further do nothing to prevent debris from damaged trailer homes and their contents from becoming airborne in a hurricane and causing further damage and destruction, both to human life and other property.

Use of canvas or nylon tarps or tarpaulins to protect property from wind and rain is also generally known. However, use of canvas tarps or tarpaulins, for the purpose of protecting mobile homes from damage from airborne debris in a hurricane, even if employed in the novel and inventive manner disclosed herein, would highly be unsuitable and indeed unworkable. In particular, to resist large volumes of wind, any canvas or nylon tarpaulins need to be of such thickness that their weight makes them extremely difficult to work with in placing over a trailer home, not to mention the increased expense in the number and size of ground anchor means necessary to retain the tarpaulin in high winds. In addition, once becoming rain-soaked, tarpaulins tend to sag, thereby trapping water and placing additional weight on the trailer, which, if such water were allowed to accumulate, may result in structural damage to the trailer home.

Accordingly, there exists a real need for a novel apparatus and method to shield and anchor property such as aircraft, boats, buildings and particularly, mobile homes from destruction in gale-force winds. In addition, there exists a further real need to contain resultant debris from any of such property which may be destroyed due to impact from airborne debris to prevent such debris from itself becoming airborne and causing further destruction.

SUMMARY OF THE INVENTION

In order to overcome the disadvantages of the prior art, the present invention discloses a means/apparatus for simultaneously shielding, anchoring, and containing objects such as aircraft, boats, buildings, vehicles and trailer homes in the event of gale-force winds.

Advantageously, the apparatus of the present invention uses wind-permeable perforate sheets means, which in the preferred embodiment consists of flexible webbed netting, which may be placed in a prescribed manner over or around an object which is sought to be protected against impending gale-force winds or a hurricane. The flexible netting extends outwardly and downwardly at an acute angle from an upper part, preferably the top of the object and is affixed to ground anchors interspersed around the periphery of the object, to thereby anchor the net in place. In such manner, the object is contained within an enclosure, and each of the sides of the object are surrounded by an inclined sloped surface of the net.

Advantageously, by providing an inclined, substantially planar, sloped surface around the sides of the object, the object may thereby be protected from impact and bombardment by airborne debris during a hurricane, thereby preventing structural damage to the object. The inclined sloped surfaces of the net means allow substantial passage of wind therethrough, but prohibit passage of windborne debris such as bricks, stones, such as B3 gravel, trees, flotsam, wood spars and the like, which would otherwise impact and destroy or at least seriously damage, by penetration thereof or otherwise, the object. The perforate sheet means or net is of sufficient strength to resist impact with such projectiles, but further assists in preventing airborne debris from impacting the sides of the object by its sloped configuration, which assists in deflecting such airborne matter away from the sides of the object.

Accordingly, in its broadest aspect, the apparatus of the present invention comprises the combination of:

(i)an oversize wind-permeable perforate sheet means of a surface area substantially greater than the combined surface area of the top and sides of an object over which it is adapted to be placed, wherein such sheet means is extendable downwardly and outwardly from the top at an acute angle to the sides of the object;

(ii)a plurality of ground anchor means adapted for placement in the ground surrounding said object; and (iii)attachment means, attachable to the periphery of the perforate sheet means, to allow the perforate sheet means to be secured to the ground anchor means.

In a further aspect of the present invention, there is disclosed a method of simultaneously shielding, anchoring, and containing an object in the event of gale-force winds. Such method comprises the steps of:

1 casting an oversize, substantially wind-permeable flexible net means over said object so as to substantially cover the top of the object; and 2 attaching the wind-permeable net means proximate an outer peripheral edge thereof to ground anchor means, so that the net extends downwardly and outwardly from the top at an acute angle to each of the sides of the object, so as to surround at least a substantial portion of each of the sides with an inclined, wind-permeable surface.

In a preferred embodiment, the apparatus of the present invention further comprises the combination of:

1 an oversize wind-permeable perforate sheet means of a surface area substantially greater than the combined surface area of a roof and outer side walls of a trailer home over which it is adapted to be placed, wherein such sheet means is extendable downwardly and outwardly from the roof at an acute angle $\alpha$ to the outer side of the walls of the mobile home;

2 a plurality of ground anchor means adapted for placement in the ground surrounding said home; and 3 attachment means, attachable to the periphery of the perforate sheet means, to allow the perforate sheet means to be secured to the ground anchor means.

In a further preferred embodiment of the present invention, there is disclosed a method of simultaneously shielding, anchoring, and containing a trailer home or motor home in the event of gale-force winds. Such method comprises the steps of:

1 casting an oversize, substantially wind-permeable flexible net means over a mobile home so as to substantially cover the roof of the home; and 2 attaching the wind-permeable net means proximate an outer peripheral edge thereof to ground anchor means, so that the net means extends downwardly and outwardly from the roof at an acute angle $\alpha$ to each of outer side walls of the trailer home, so as to surround at least a substantial portion of each of the outer side walls with an inclined, wind-permeable surface.

Surprisingly, I have found that by providing a net formed of a resiliently flexible material, such as a flexible thermoplastics material, sufficiently taut around the object as to give the net one or more flat stationary planes, acutely angled to the object, that windborne debris can be restrained and deflected from the object to prevent damage thereto. I have found that when such debris hits the net with appreciable force, the net is temporarily deformed at an area of at least one of these flat, stationary planes under the impact of the flying debris. The resilient net material absorbs the energy of impact and surprisingly, this energy is distributed throughout the net adjacent the impact site and transferred to the restraining anchor means. The extent of this impact energy distribution throughout the net to the anchors allows of the unexpectedly high degree of efficacy of the net in restraining and deflecting the debris.

Thus, the invention provides a combination and method as hereinabove defined wherein a side or face of the net is so formed as to be deformable from its stationary plane and so biased as to deflect or restrain windborne flying debris by absorbing impact energy by distribution thereof through said material.

The net is, thus, so formed and taut as to constitute resiliently flexible deflection means to deflect and restrain flying debris.

While it is desirable to have the net fully covering the object to be protected, for example, in the case of a building, trailer or mobile home, the roof and sides, the invention is applicable to those situations where only one or more sides need to be protected. One edge of the sheet may be attached to only one side of a structure to protect a window or the like, with the opposite edge being secured to the adjacent ground or surface at a distance from the base of the structure. Also within the scope of the present invention are those embodiments wherein the net is spaced away from, but adjacent an upper part of the object, structure and the like, to be protected. The net may be directly or indirectly supported on or by a frame so spaced away from the object but to be effective in providing the desired protection from windborne debris. Such arrangements in this specification and claims are embraced by the terms "adapted for placement around said object" and "adapted for placement over the roof" and the like.

Thus, the system of the invention in one aspect has the net fully covering the top of the object, for example the roof of a trailer home. This provides a means of restraining and containing the home and any contents contained therein should the sides of the home be penetrated to allow air pressure build up within the home. In an alternative embodiment, the home may be contained and restrained by the system notwithstanding the net does not fully cover the top or roof of the home.

The substantially wind-permeable, flexible netting extends outwardly and downwardly at an acute angle from an upper part to provide a stationary substantially planar inclined sloped surface around the sides of the object and is of sufficient strength and resilience so as to effect distribution of the energy of impact between windborne debris and the netting throughout the netting and, optimally, as far as the anchor means. Such efficacious distribution of the impact energy reduces the likelihood of a breakthrough of the net to allow airborne debris to pass therethrough.

Preferred flexible materials are resiliently flexible thermoplastics such as the polyolefins, polyesters and polyamides. Preferred polyolefins are polymers and copolymers of the ethylene, propylene and polybutadiene families with for example other olefins and vinyl acetate. As examples, high density, low density and linear low density polyethylenes and 1,2-polybutadienes may be mentioned. The term "polyethylene" includes ethylene homopolymers, and copolymers of, such as for example vinyl acetate, acrylic acid, methyl methacrylate, butene, n-hexene, 4-methyl-1-pentene and octene polymers with ethylene and blends thereof. Most preferred polyethylenes have oriented molecular structures, such as gel spun oriented polyethylenes sold under the trade marks of SPECTRA, DYNEEMA, MIKELOW. A preferred polyester is polyethylene terephthalate. By the term "nylon" as used in this specification is meant melt-processable thermoplastic polyamides whose chain structure features repeating amide groups, such as, for example, amorphous nylon, nylon-6, 6 (polyhexamethylene adipamide), nylons-6,9,-6,10 and -6,12, nylon 6 (polycapromide), nylon 11, nylon 12, polymers, copolymers and blends thereof. A preferred polyamide material is Nylon 6,6 copolymer of 1,6-diaminohexene and adipic acid.

I have found that one of the benefits of the protective net system of the invention is a reduction in wind pressure on the windward surface of the object protected by the net, due to reduced passage of wind through the net.

I have found that when preferred nets of use in the invention were tested to failure by the impact on the net of either a heavy test weight in a drop test or by a projectile fired from an air cannon to effect breakthrough, that the resulting hole caused by the impact was so localized that the efficacy of the net in continuing to provide a protective membrane around an object was not substantially affected. A protective system capable of such continued efficacy is most valuable. This should be contrasted with systems formed of non-resiliently flexible materials such as tempered and heat strengthened glass, wood, such as plywood, chipboard and the like, aluminum sheeting and steel wire, which are most likely to break, shatter or collapse under comparable impact energies.

The mechanical characteristics of the net of use in the practice of the invention, such as mesh size, fabric denier and fabric and net construction may be readily and suitably determined from the physical characteristics of the flexible material in view of the desired efficacy.

The size of the mesh of the net not only influences the range of projectile sizes which the net will stop, but also is a factor in the capability to absorb the energy of an impact. Smaller mesh sizes allow objects to strike more net elements, which better dissipates the impact energy. In order to withstand a given impact, a net with larger mesh size has to weigh more than a net with smaller mesh size.

The net of a typical 4 m×4 m dimension, preferably, should be able to withstand an impact energy of at least 400 Joules, more preferably more than 500 Joules and most preferably at least 800 Joules.

Table 1 shows the energy to break ($MJ/m^3$) values for several thermoplastic fibres of use in the practice of the invention.

The area under the curve of a graph of tensile strength (MPa) plotted against elongation L/L is a rough measure of the energy to break the fibre i.e. the breaking energy per unit volume of fiber material. These values have been divided by the density of the fiber to obtain the equivalent specific fracture energies in J/g.

TABLE 1

| Fibre | Tensile Strength (MPa) A | Elongation to Break (ΔL/L) B | Energy to Break AB/2 ($MJ/M^2$) |
|---|---|---|---|
| Nylon 66 | 300–960 | 0.16–0.66 | 75–100 |
| Nylon 6 | 400–910 | 0.16–0.5 | 73–100 |
| Polyethylene Terephihalate (PET) | 270–1160 | 0.12–0.55 | 70–75 |
| Polypropylene | 240–640 | 0.14–0.8 | 45–95 |
| Polyethylene | 290–590 | 0.1–0.45 | 30–65 |
| Kevlar (Dupont) | 2760 | 0.03 | 42 |
| E-Glass | 2100–4500 | 0.03–0.05 | 55–70 |

The following explanation is given by way of guidance in determining the configuration of the thermoplastics material constituting the net.

The specific energies of most synthetic fibres are approximately 50–100 Joules/gram. In the case of, for example, a 4.09 kg projectile impacting at 15 meters/second, a kinetic energy of impact of approximately 460 Joules is imparted to the net. A net having a mass and configuration resulting in a distribution of 0.033 $g/cm^2$ thermoplastics material will thus require about 3.3 $Joules/cm^2$ to effect breakage. For a projectile impacting on an area of 34 $cm^2$ the net will withstand a load of up to 112.2 Joules.

The force on the impact area will be distributed over the entire area of the net such that the stress will decay outwardly from the area of impact wherein approximately half the impact energy will be dissipated outside the periphery of the contact zone. Some energy may be converted to heat by plastic flow and friction.

Thus, a heavy object, travelling at a high velocity and impacting a small area will exceed the breaking energy, eg. a steel rod impacting at one end. A solid spherical rock (density 2.8 g/cm$^3$, a diameter of about 10 cm) travelling at 15 m/s would impart about 165 kJ to the net. About half of this energy 82.5 J is concentrated on an area of 78.5 cm$^2$, with the remainder being largely dissipated over the entire structure.

However, the net will support more than 240 J for an area of 78.5 cm$^2$ assuming a net fabric weight of 0.033 g/cm$^2$. This is a worst case scenario which assumes all energy is transmitted to this small area of the net. In practice, some of the energy is spread out over the whole net and to the anchors. This example suggests that stones, even large ones, cannot penetrate the net at 15 m/s but might penetrate at velocities above 24 m/s for a fabric having an areal weight of 0.033 g/cm$^2$. Thus, the weight/unit area of the fabric net determines the resistance to penetration. Since stones/masonry are the most likely source of damage, a 0.066 g/cm$^2$ fabric should prevent penetration at a velocity of 30 m/s.

Table 2 below gives the approximate minimum weight/unit area of a plastics net material derived to prevent breakthrough at the given velocities for a spherical object weighing 4.09 kg and having a density of 2.89 g/cm$^2$. The specific energy to break of 100 J/g of the fibre is assumed to be a reasonable average for synthetic fibres.

TABLE 2

Impact Rating of Net for a Spherical Object (mass: 4.09 kg; density 2.8 g/cm$^3$)

| Velocity | | Kinetic Energy of 4.09 kg | |
|---|---|---|---|
| m.p.h. | m/s | object (Joules) | Weight of Net, kg/m$^2$ |
| 50 | 22 | 990 | 0.7 |
| 60 | 27 | 1490 | 1.0 |
| 70 | 31 | 1965 | 1.3 |
| 100 | 45 | 4141 | 2.6 |
| 120 | 54 | 5963 | 3.8 |
| 150 | 67 | 9180 | 5.9 |

The net may optionally be formed, for example, of an extruded, woven or non-woven, knotted, knitted, crocheted or braided, knotless web. Preferred configurations are those known as a raschel crocheted knit or as a lockstitch configuration.

A woven i.e. interlocked perpendicular threads configuration is less preferred in the practice of the invention. Intersections can easily slip to allow relatively large holes to be formed without actual breakage of any fibres.

In extruded netting, net elements are solid strands of material, instead of assemblages of fibres having solid intersections. Extruded netting can be very cheap, but strength is low due to the lack of the alignment of molecules and stiffness may be quite high.

Knotted netting is efficacious but is less preferred and is generally formed with pre-assembled cord. However, preferred small mesh sizes are generally impractical to manufacture, and strength is lost in the knots. Thus, use of such a configuration requires a heavier net with reduced ability to stop small debris.

Braided netting, where yarns cross each other in a regular pattern, allows for high strength and a high degree of stretch. Intersections can be knotless (e.g. Ultra Cross configuration), giving no reduction in strength. Intersections allow some limited slip, which may allow failure to a limited degree to propagate from one element to another.

One edge of net arrangement of use in the invention consists of reinforcement with either 5 cm wide nylon, polyester or polypropylene webbing folded over the edge of the net and stitched on, typically with two rows of stitches, to leave a 2.54 cm strip of webbing along the edge. The net may itself be reinforced at the edge by increasing the amount of material used in the raschel knit. This is a straightforward procedure with raschel machines. Rings are attached to the edging using 2.54 cm webbing, and straps are used to attach these rings to a peripheral cable, which is in turn attached to ground anchors.

Further objects and advantages of this invention will appear from the following detailed description of the invention.

BRIEF DESCRIPTION OF THE DRAWINGS

In order that the invention may be better understood, preferred embodiments will now be described by way of example only with reference to the accompanying drawings, wherein.

DETAILED DESCRIPTION OF THE INVENTION

Figure 1:
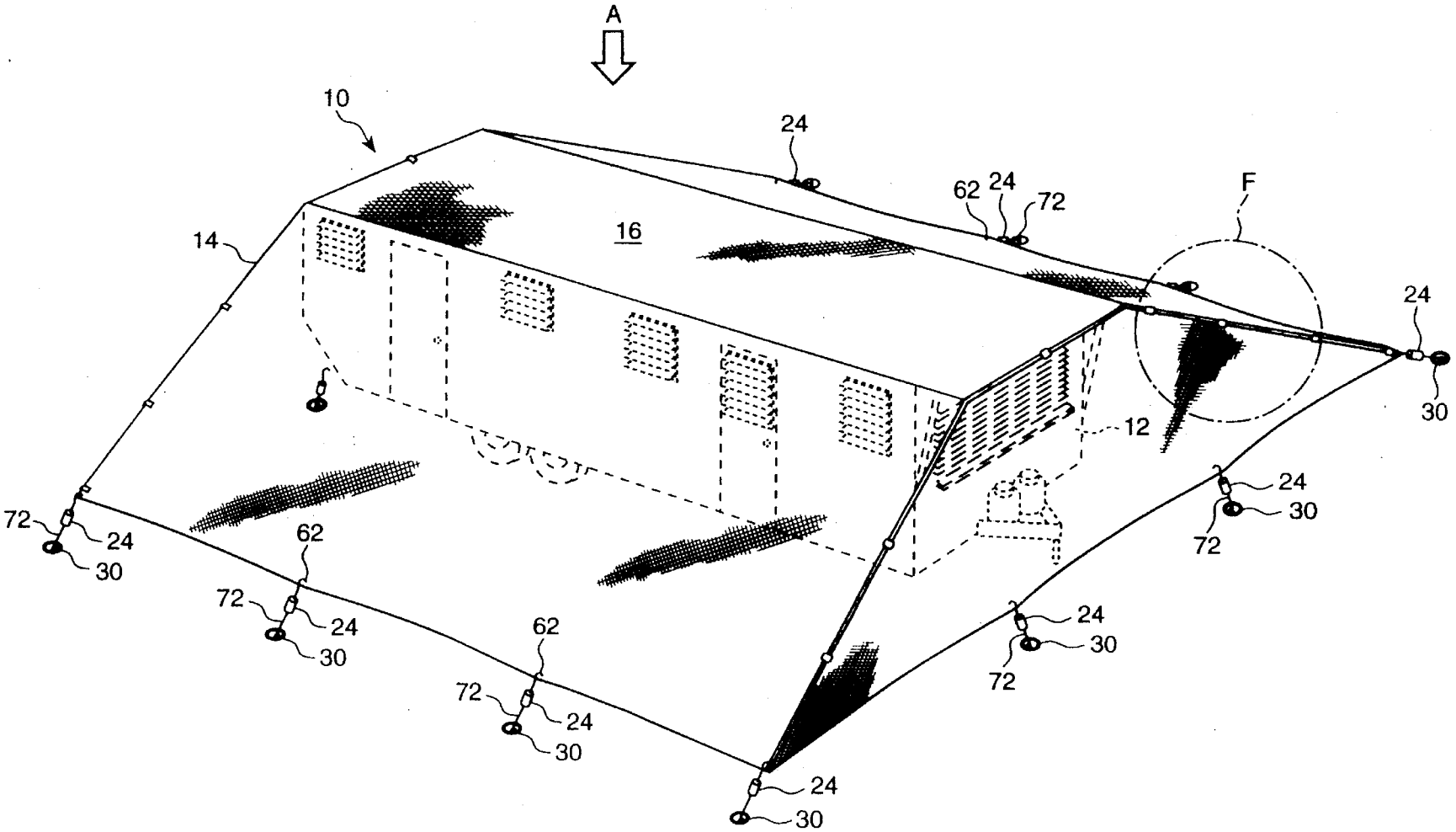
FIG. 1 is a perspective view of the apparatus of the present invention, in its intended-use position to shield, anchor, and contain a trailer home in gale-force winds.
Figure 6:
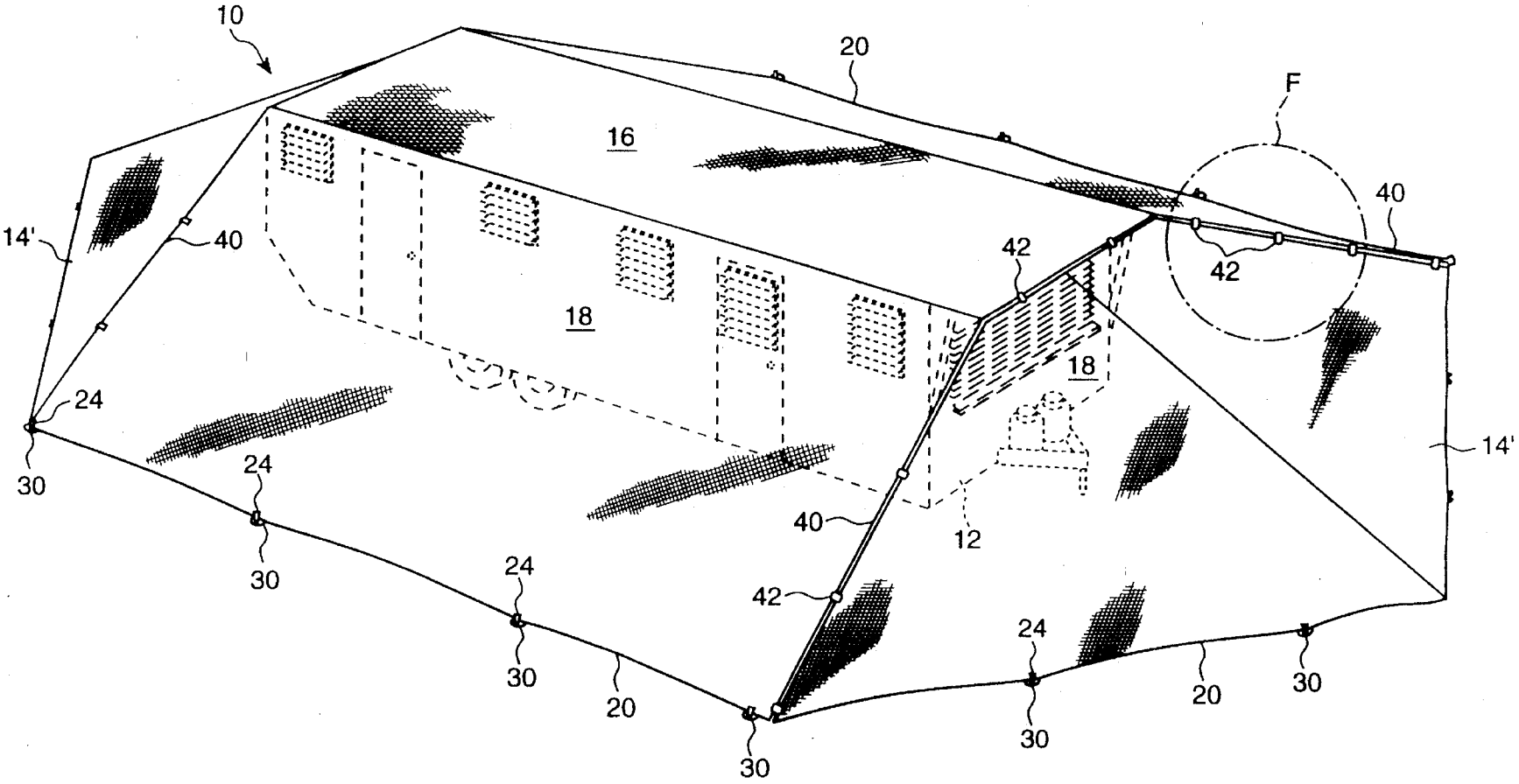
FIG. 6 is a perspective view of another embodiment of the apparatus of the present invention, in its intended-use position to shield, anchor, and contain a trailer home in gale-force winds.

FIGS. 1 and 6 show a perspective view of two different embodiments of the apparatus 10 and method of the present invention for securing trailer homes and motor homes 12 (hereinafter mobile homes) against gale-force winds.

An oversized, substantially wind-permeable perforate sheet means 14, capable of being cast or placed over the roof 16 of a mobile home 12, is contemplated as an essential component of the apparatus 10 of the present invention. In the preferred embodiment, the perforate sheet means 14 is a flexible woven net, preferable formed of a water-resistant braided polyethylene.

Figure 2:
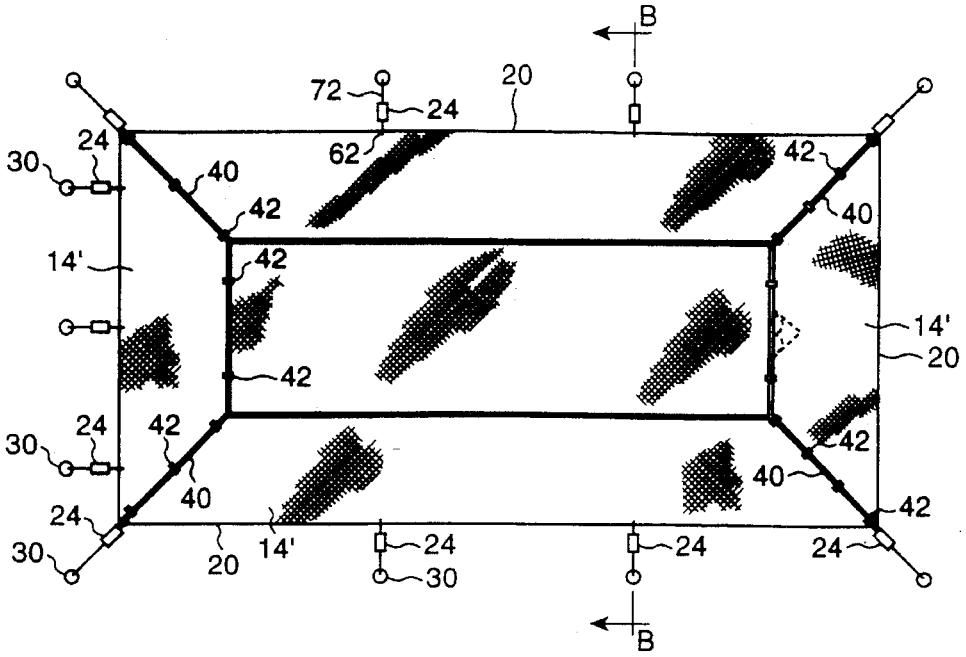
FIG. 2 is a plan view of the apparatus of the present invention, in the direction of arrow "A" in FIG. 1.

The surface area of the sheet means or net 14 of the present invention is greater than the combined surface area of the roof 16 and side walls 18 of the trailer home 12. This excess size is important, since a necessary requirement of the invention is that net 14 when placed over the roof 16 of the mobile home be adapted to extend downwardly and also outwardly from the roof 16 at an acute angle α to the outer side wails 18 of the mobile home so as to create a protective inclined sloped surface 25 around each outer wall 18, as shown in FIGS. 1, 2 and particularly FIG. 3.

Figure 3:
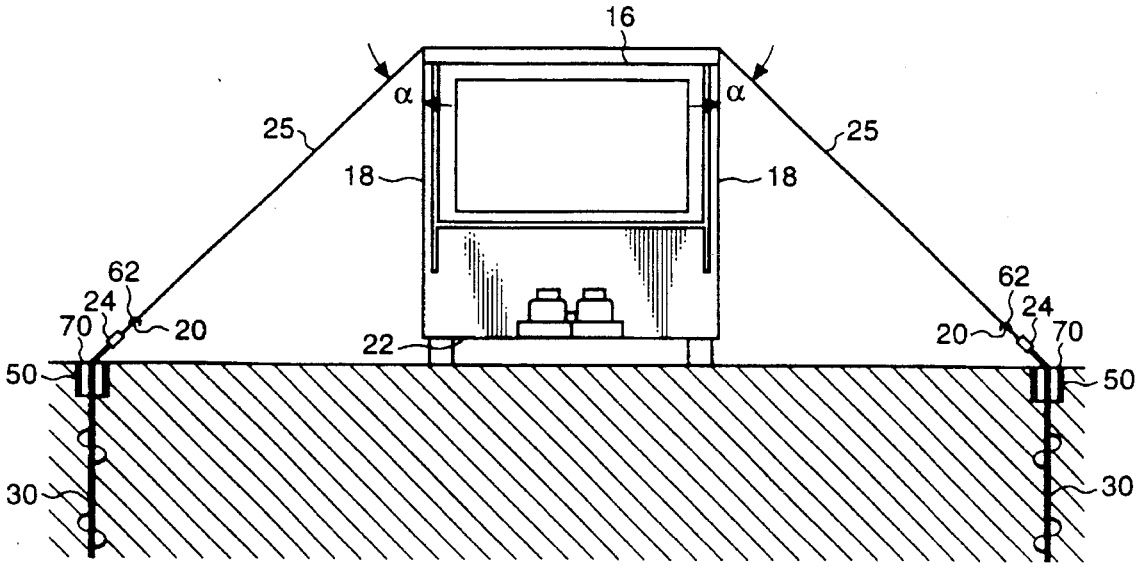
FIG. 3 is a section view of the apparatus of the present invention, taken along plane B—B of FIG. 2.

In a preferred embodiment, net 14 extends downwardly and outwardly so that the outer peripheral edge 20 thereof extends to at least the level of the lowermost portion 22 (floor) of the mobile home 12, so as to provide a protective inclined surface 25 proximate the entire surface of each outer wall 18 of the mobile home, as shown in FIG. 3.

Figure 5:
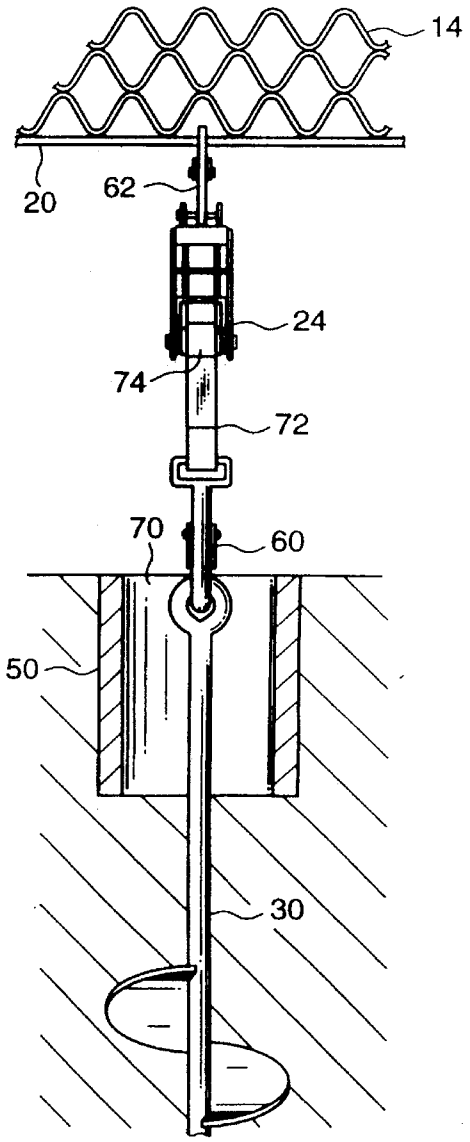
FIG. 5 is a view of an arrow 'c' of FIG. 4.
Figure 4:
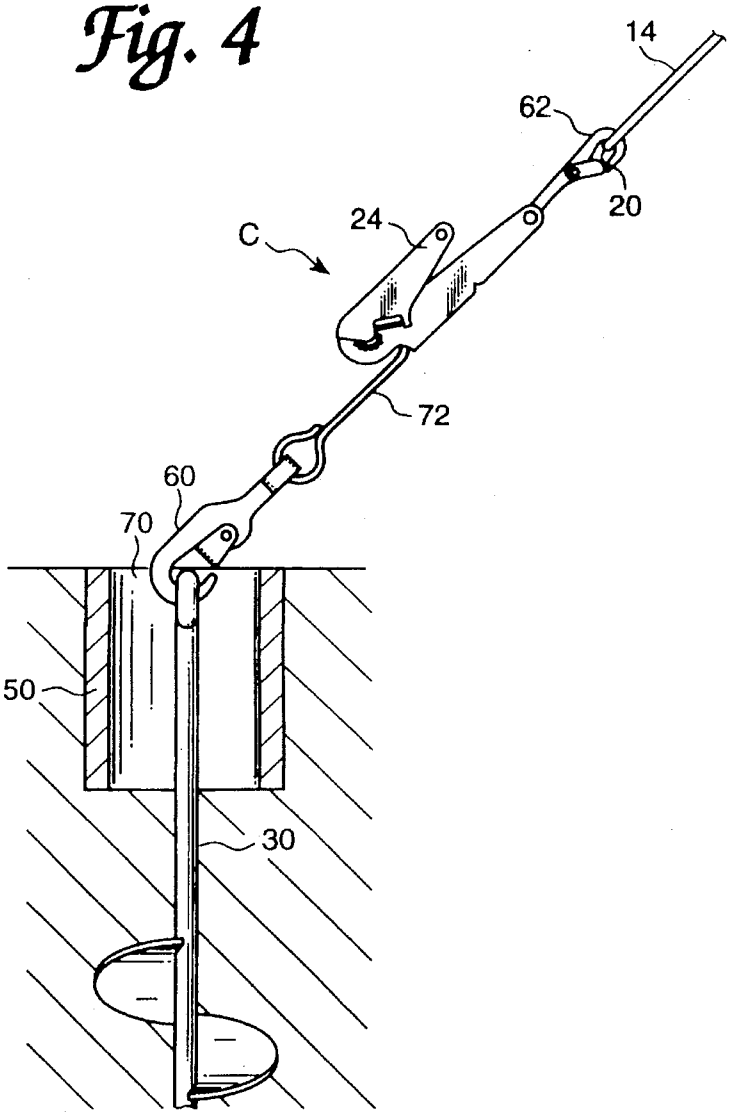
FIG. 4 is an enlarged cross-sectional view of the attachment means and anchor means of the present invention shown in FIG. 3.

Attachment means 24 are further provided, as shown in FIG. 1 and in greater detail in FIGS. 4 and 5, attachable to the perforate sheet means 14 proximate the outer peripheral edge 20 thereof. Such attachment means 24 allow net 14 to be attached to ground anchor members 30 located in the earth surrounding the mobile home 12 (see FIGS. 4 and 5), to thereby maintain net 14 in the angular outwardly extending position as shown in FIG. 3 around all outer sides 18 of mobile home 12. More particularly, it is desirous that the anchor means 30 be interspersed about the periphery of mobile home 12, as shown in FIGS. 1 and 2, and the dimensions of net 14 be such that net 14 is maintained at an outwardly extending angle α from the outer walls 18, as shown in FIG. 3. In a preferred embodiment angle α so formed between the net and the outer side walls is between 15°–60° and preferably between 20°–35°. Angle α should be a compromise between as high a value as possible to thereby afford as a "shock-absorbing" distance between net 14 and outer walls 18 to allow net 14 to protect walls 18 from airborne debris, while at the same time being as low a value as possible to thereby minimize the size of the net means 14 required.

Since mobile homes are generally of sizes ranging from 30 ft.–70 ft. in length, by 10 ft. in width, net 14 needs to be of a general rectangular shape of at least 30'×50' (1,500 sq. ft.) for the smallest trailer home size of 30'×8'×10', in order to have a protective inclined sloped surface 25 extending outwardly and angularly downwardly to protect substantially all of the outer side walls 18 of mobile home 12 to the level of the floor 22 of the trailer home. Dimensions of this size will permit an angular slope α of net 14 of up to approximately 30°. Angle α should be the greatest value possible at which net 14 will extend with its peripheral edge 20 to a position level with the floor surface 22 of the mobile home, to thereby ensure walls 18 are entirely protected from horizontally-moving airborne debris.

Mobile home sizes greater than 30'×8'×10' require nets 14 of dimensions larger than 1,500 sq.ft. if an angle α is to be maintained and if peripheral edge 20 of net 14 is to extend to a level of floor 22 to thereby protect all of the surface area of the outer walls 18 from impact damage due to airborne debris.

Figure 7:
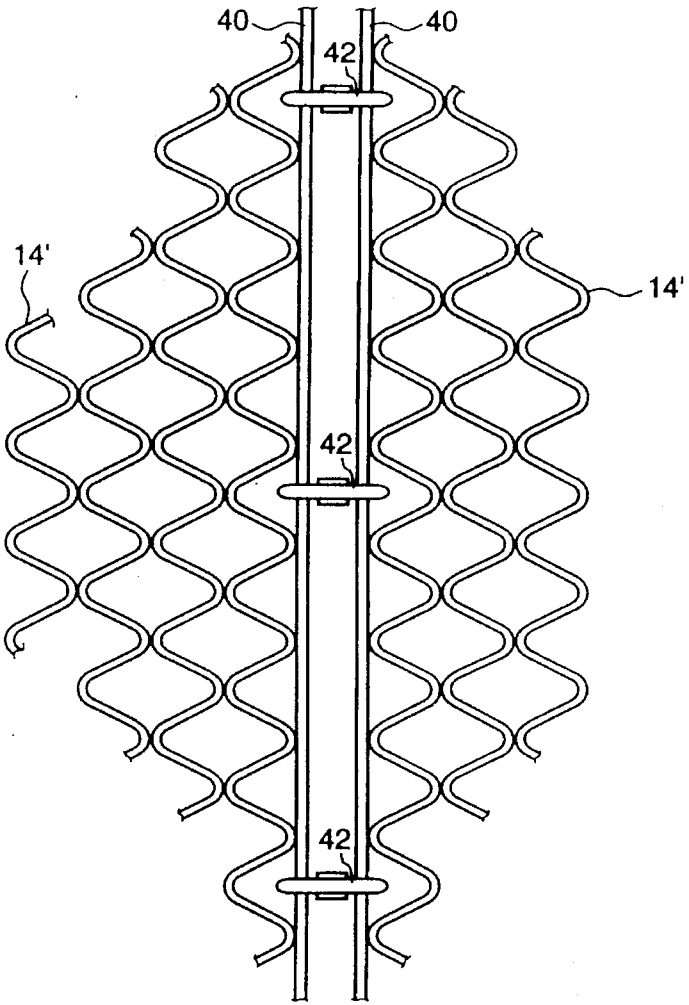
FIG. 7 is an enlarged view on the area designated as 'F' in FIGS. 1 and 6 showing coupling means for joining sections of perforate sheet together.

Notably, in order that net 14 when placed over the mobile home be adapted to extend evenly and uniformly downwardly and outwardly with a minimum of bunching and folding in a preferred embodiment the perforate sheet means is comprised of two or more irregular shaped perforate sheets or nets 14' joinable along various seams 40, as shown for example in FIGS. 1, 2 and 7. Accordingly, when a perforate sheet means 14 assembled in the preceding manner is placed over mobile home 12 and attached to the anchor means 30, a wrinkle and bunch-free sloped surface 25 is thereby formed proximate each of outer walls 18 of mobile home 12, as shown in FIGS. 1, 2 and 6.

To accomplish the joining of each of the various perforate sheets 14' which comprise entire net 14 releasable coupling means 42 may be utilized to join the perforate sheets along a seam 40 thereof, as shown in FIG. 7. These coupling means 42 may be of any type commonly known in the art, but in a preferred embodiment are a steel 'D'-shaped snap-ring.

Advantageously, releasable coupling means 42 along one or more seams 40 allows entry by a person in and out of the mobile home 12 when the apparatus 10 of the present invention is assembled about the mobile home.

Notably, the force exerted by gale-force winds of up to 150–160 miles per hour, as was recently experienced in Hurricane Andrew which struck the eastern seaboard of the State of Florida and some of the other states surrounding the Gulf of Mexico, including Louisiana, in August 1992, can be quite significant.

Utilizing the formulas:

$P=C\times V^2$ and $F=P\times A$ where:

P is pressure in lbs. force exerted on an area,

C is a constant of $$0.0027\times\frac{\text{lb hr}^2}{\text{ft}^2\text{mi}^2}$$

(assuming air at a specified density at standard temperature and pressure)

V is velocity in miles per hour, and

A is the surface area, the maximum force exerted by a wind of a given velocity against a perpendicularly-disposed outer wall 18 of a trailer home of a given area A can easily be calculated.

From Table 3, it can be seen that the force exerted by a gale-force wind of 160 miles per hour on a mobile home size of 45'×8' (×10') can exceed 24,000 pounds.

TABLE 3

| Wind Speed (mph) | Pressure (lb/ft$^2$) | Wall Size of Mobile Home (ft$^2$) | Force (lbs) |
|---|---|---|---|
| 50 | 6.75 | 280 (35' × 8') | 1890 |
| | 6.75 | 360 (45' × 8') | 2430 |
| 60 | 9.72 | 280 (35' × 8') | 2722 |
| | 9.72 | 360 (45' × 8') | 3499 |
| 70 | 13.23 | 280 (35' × 8') | 3704 |
| | 13.23 | 360 (45' × 8') | 4763 |
| 80 | 17.28 | 280 (35' × 8') | 4838 |
| | 17.28 | 360 (45' × 8') | 6221 |
| 90 | 21.87 | 280 (35' × 8') | 6124 |
| | 21.87 | 360 (45' × 8') | 7873 |
| 100 | 27 | 280 (35' × 8') | 7560 |
| | 27 | 360(45' × 8') | 9720 |
| 110 | 32.67 | 280 (35' × 8') | 9148 |
| | 32.67 | 360 (45' × 8') | 11761 |
| 120 | 38.88 | 280 (35' × 8') | 10886 |
| | 38.88 | 360 (35' × 8') | 13997 |

To resist a force of such magnitude applied by a 160 mile per hour wind perpendicularly contacting a wall of a mobile home, the net means 14 is affixed to suitable anchoring means 30. It is contemplated that anchor means 30 of the present invention be comprised of elongate multi-helix screwable anchors 30, which may be mechanically screwed into the ground (see FIG. 3).

A number of such anchor members 30 are commercially available. One such product is multi=helix anchor manufactured by Dixie Electrical manufacturing Company of Birmingham, Ala., under Cat. No. D-284 for a tandem 8" helix anchor. According to information supplied by said company, such anchor depending on soil type and length of anchor, when inserted into the soil can resist a load of between 10,000 to 30,000 lbs. Using such information, knowing of the appropriate soil conditions, the necessary approximate spacing of such anchor means 30 around the periphery of a mobile home can be determined to secure net 14 about a mobile home 12. The anchors may be installed ahead of net deployment and constitute capped sub-ground members.

To avoid anchor means 30 protruding upwardly and creating a safety hazard, it is contemplated in a preferred embodiment that anchor means 30 be recessed below the surface of the earth, as shown in FIGS. 3, 4 and 5. To facilitate this, a recessed well 70 may be further provided to surround anchor means 30, within which a cylindrical hollow canister 50 may be placed level with the surface of the ground, as shown in FIGS. 3, 4 and 5. When anchor means 30 and apparatus 10 of the present invention is not in use, a cylindrical cover plate (not shown) may be placed over the cylindrical canister 50, to thereby conceal and hide anchor means 30 from view.

Commercial cylindrical canister devices 50 and cover plates suitable for such purposes are available. For example, Brooks Products Inc., Polyplastic Division, of Cucamonga, Calif. provides a "60 series Valve Box" which is ideally suited to this purpose.

The attachment means 24 of the present invention may simply comprise a releasable attachment mechanism, such as a snap-ring, for releasably attaching the net 14 at any point proximate the peripheral edge thereof directly to anchor means 30, as shown in FIG. 6. In a preferred embodiment, however, it is contemplated that the attachment means 24 further comprise means for tightenably securing flexible net 14 to anchor members 30.

Accordingly, it is further contemplated that attachment means 24 comprise a pair of releasably securable hooks 60, 62, one of which may be secured to anchor 30 and the other to net 14 as shown in FIGS. 4 and 5. Rollable webbing connects the two hooks 60, 62, and crankable tightening means 70 is further provided to wind the webbing 72 onto a spool 74, thereby bringing hooks 60, 62 together to thereby tighten net 14 to anchor 30, as shown in FIGS. 4 and 5. An example of such a commercially available tightening means ideally suited to this purposes is model FE 400 (P/N802) Ratchet Strap, sold by Kinedyne Corporation of North Branch, N.J., having a breaking strength of 11,000 lbs., with a 2" cranking handle, and hooks 60, 62 interposed at each end.

An extremely lightweight and water resistant high-strength fibre particulary suited for net means 14 of the present invention is a braided line netting comprised of a polyethylene homopolymer having a high modulus of elasticity and a molecular weight of over 500,000. An example of such a commercially available fibre is SPECTRA*[1] manufactured by Allied Fibers, a division of Allied Signal Inc. of Petersburg, Va. In "single braid format, such fiber has a break strength of approximately 48,000 lbs., and a weight of approximately 22 lbs. per 100 ft. of rope.

*[1] Trade Mark of Allied Signal Inc. for polyethylene twine and rope.

In one embodiment, two netting configurations are preferred and are commercially available. One is the Ultra Cross Spectra (a registered trademark of Allied-Signal Inc.) available from NET and the other is Raschel Nylon from Polytech. Nylon is not quite as strong as the "Spectra" fiber.

Figure 12:
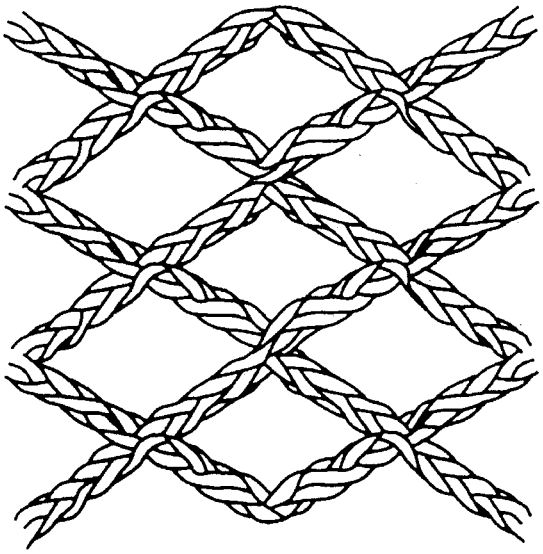
FIG. 12 is an illustration of a net useful in the present invention.
Figure 13:
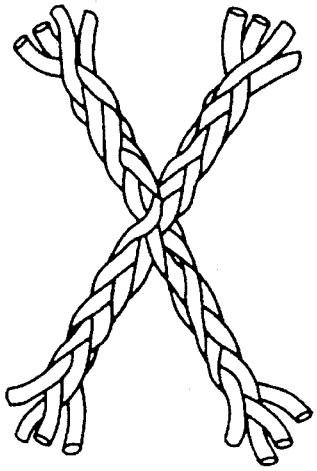
FIG. 13 is an enlarged view of an intersection of the net of FIG. 12.

The net sold as Ultra Cross Spectra comprises four bundles of fibers to make the twine. Intersections are formed by braiding the two twines through each other. This will avoid the stress concentrations seen in knotted netting. This net is illustrated in FIG. 12 and the braid and intersection in the enlargement of FIG. 13.

Figure 8:
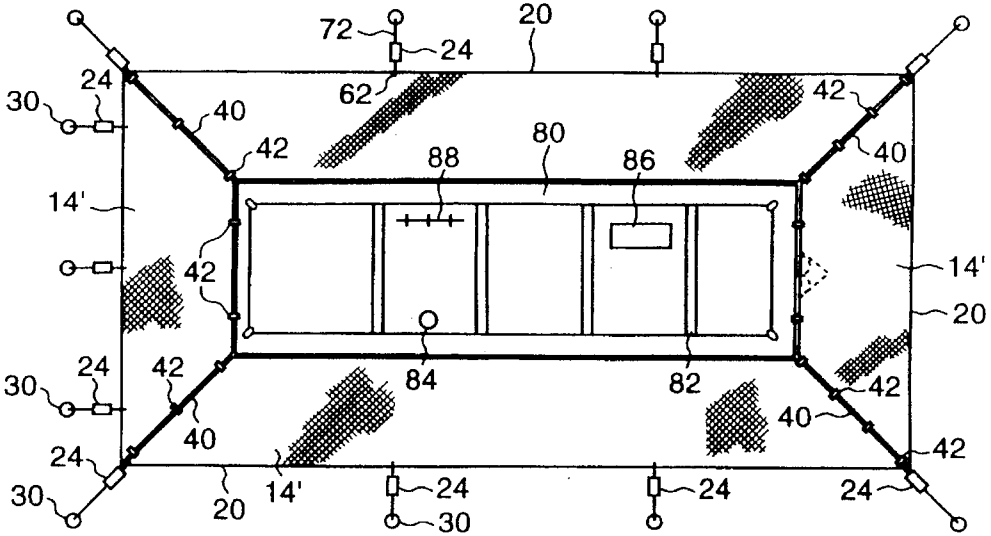
FIG. 8 is a plan view of an alternative apparatus of the invention.

FIG. 8 shows an embodiment of the invention wherein the net 16 does not fully cover the top of home 12 but has peripheral net covering strips 80 taped and sewn to transverse restraining straps 82 formed of a plastics webbing material, such as nylon. Such an arrangement provides partial roof covering which allows protrusions such as vent pipe 84, air conditioning unit 86 and television arial to extend above the net, if so required.

Figure 9:
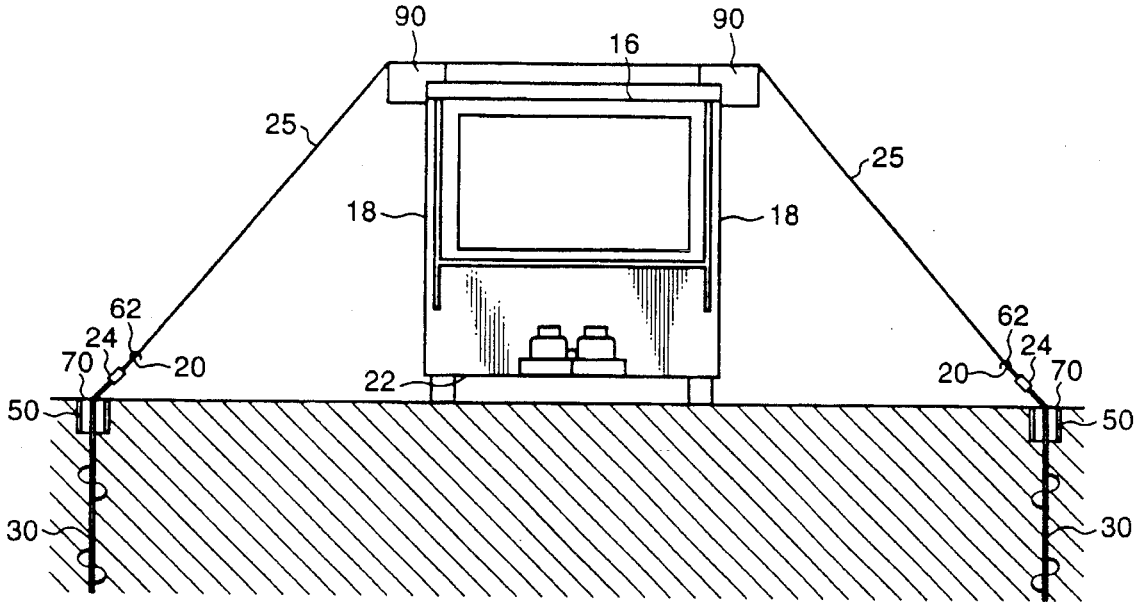
FIG. 9 is a sectional view of an alternative embodiment of the invention showing an alternative net deployment system.

FIG. 9 shows an embodiment having a pair of displacing members 90 formed of a suitable material, such as, for example, polystyrene foam or rubber blocks arranged lengthwise of the roof line to provide a means of deploying the net away from the home at its upper parts to provide less risk of impact damage to these parts should a wind-borne object hit the net with sufficient force to produce extensive permanent or transient deformation of the net.

Figure 10:
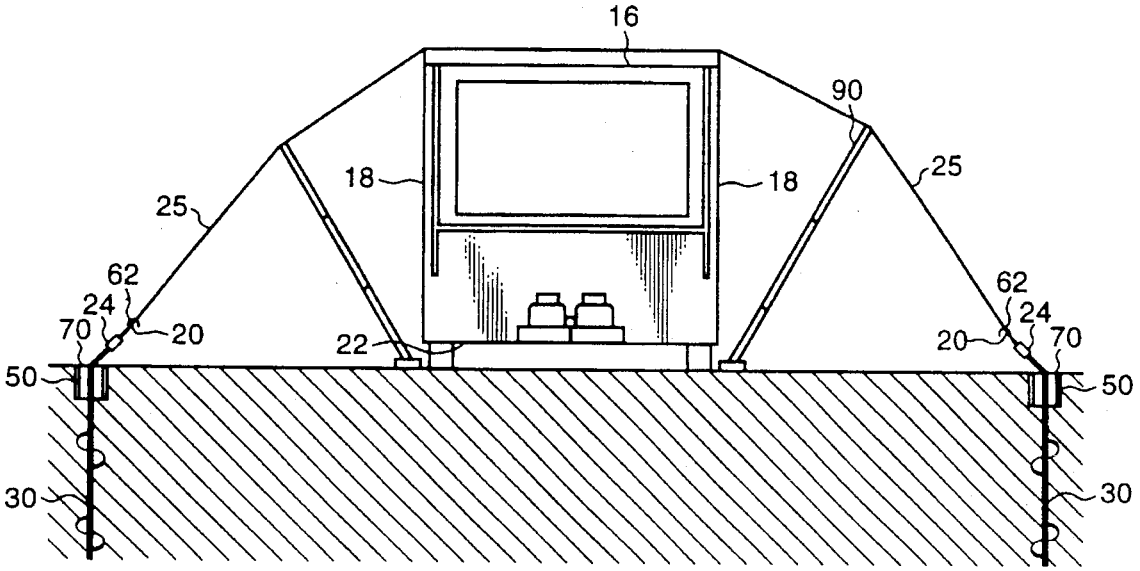
FIG. 10 is a sectional view of an alternative embodiment of the invention showing a further alternative net deployment system.

FIG. 10 shows an alternative means of providing for the net to be deployed away from the upper reaches of the object. Angled support and deployment poles 92 are arranged around the home and engage the net so as to produce a wider angle at the upper reaches of the home between the net and the home. Poles 22 may be formed of any suitable material, such as aluminum, fibre glass or wood and each may comprise individual lengths or several smaller members suitable connectable one to another, such as by bayonet fittings, screw-in mechanism or telescopic spring loaded means.

Figure 11:
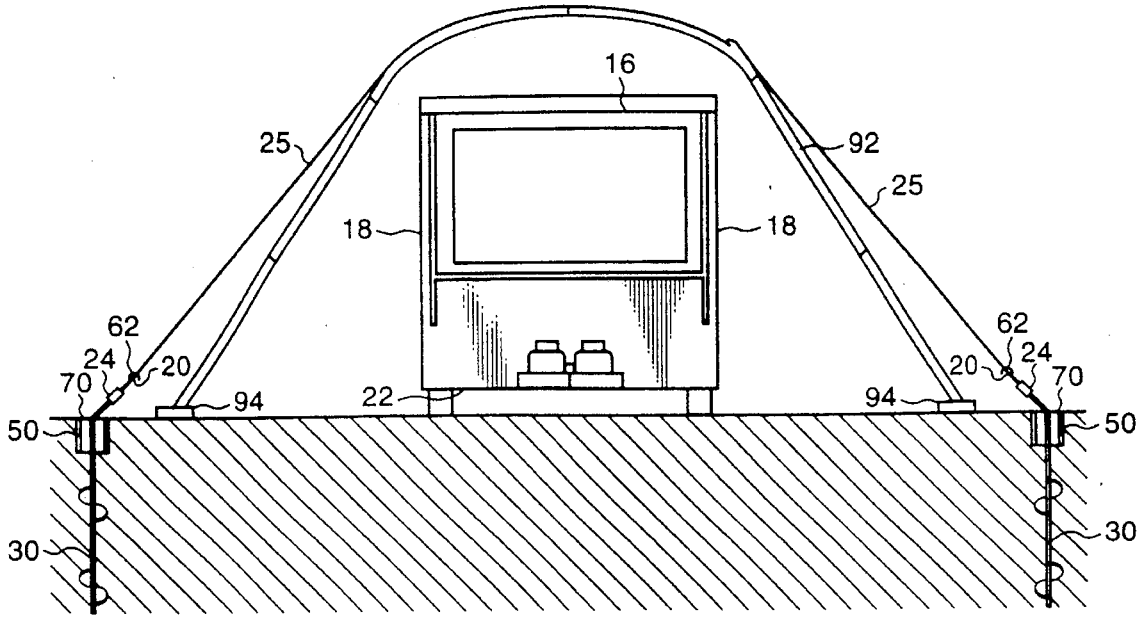
FIG. 11 is a sectional view of an alternative embodiment of the invention showing a still further alternative net deployment system; and wherein the same numerals denote like parts throughout the drawings.

FIG. 11 shows a further alternative means of separating the net from the home at the upper reaches thereof. A plurality of resiliently flexible poles 92 formed of, say, fibre glass, bamboo or like material are joined end to end and disposed over the home in the form of an arch. Each end of pole 92 is retained in a base plate 94. The upper curved portions of pole 92 may be fixed to the top of the roof by a suitable fixing means (not shown) or merely held under tension by the embracing net.

EXAMPLES

1. Raschel Nylon Tension Tests

In order to accurately model the impact of a projectile on the netting, data regarding the stiffness and strength of the netting was obtained. Simple static tension tests were performed, with load and strain data recorded at several points for each sample.

Sample Preparation

Specimens of nylon fibres were cut from a large section of netting. A single strand (0.25 cm diameter) of the netting was followed through a series of intersections. To avoid adverse effects on the test strand, intersection strands were cut roughly five diameters away from the intersection. All cuts were made with a soldering iron to eliminate unravelling. Typical sample lengths were 1.2 m.

To facilitate gripping of the specimen, and to ensure that failure occurred in the test section of the sample, the ends of each sample were threaded through the hollow core of a short length of 0.5 cm braided nylon rope. A clamp on the end of the rope nearest the test section, along with a knot a short distance away, eliminated the possibility of slippage of the specimen through the rope.

Experimental Procedure

The test apparatus used was a Tinius-Olsen tension/compression test rig. Samples (inside the rope) were wound around a 4 cm dia. steel pipe to avoid stress concentrations and tied off to a post. Elastic strands were attached to each sample at the end of the test section as references for strain measurements.

Typical crosshead separation rate was 20 mm/min. Deflections were manually measured at specific loads (e.g. every 4 kg).

Maximum load supported by each sample was also recorded.

Results

A typical plot of load vs. deflection is shown in Table 4.

TABLE 4

| Load (N) | Strain (no. units) |
|---|---|
| 0 | 0 |
| 49 | 0.09 |
| 90 | 0.15 |
| 140 | 0.20 |
| 175 | 0.24 |
| 225 | 0.27 |
| 260 | 0.28 |
| 310 | 0.30 |
| 355 | 0.32 |
| 400 | 0.33 |

2. Dropped Projectile Impact Tests (A) Large samples of netting were tested for impact absorption capability through drop tests. The sample to be tested was securely fastened to a rigid frame, and a projective of measured weight and dimensions was dropped onto the specimen from a range of measured heights.

Apparatus

The netting used was 210/20 twine, (Hafner Fabrics, Toronto, Ontario Canada), 1.27 cm length of stretched mesh 100% Nylon 6,6 (Du Pont) raschel knit configuration. The raschel knit is a knotless configuration, with strands and intersections 'crocheted' together. The designation 210/20 indicates that 20 ends of 210 denier fibre form the yarn. The resulting twine was roughly 1 mm in diameter. The mesh had a breaking strength of 25 kgs. and the mesh squares were roughly 6 mm wide.

Breaking strength is an indication of the net's capabilities. Breaking strength is measured by pulling apart one square of the finished product, so the element strength is half the breaking strength. Denier is a measure of a fibre's weight. One denier is equivalent to the weight in grams of a 9000 m length of the fibre. Thus, a 9000 m length of 210 denier fibre would weigh 210 grams. Stretched mesh size indicates the distance between intersections, along two sides of a square. Thus 1.27 cm stretched mesh corresponds to roughly 0.635 cm squares.

The raschel knit construction technique consists of essentially crocheting the yarns (three yarns together at a time) and forming loops in the net elements. Intersections between elements of the net are accomplished without knots; the crochet process continues through the intersection, with one yarn being exchanged between the intersecting elements. A main advantage of the raschel knit is its ability to stretch to a large degree: as much as 50% strain-to-failure for an element.

Another advantage of raschel is that, if one element of the net is damaged, there is no tendency for adjacent intersections, or adjacent elements, to unravel. This avoids single-point failures.

A third advantage is that intersections cannot slip significantly, due to the exchange of yarns. Thus an opening cannot be stretched wider by wind or impacts.

One more advantage is that no significant strength is lost in intersections. Knotted netting configurations lose significant performance due to the stress concentrations of the knots.

A system for edge attachment was installed on each sample of netting to be tested. Earlier versions of this consisted of a rope or cable strung through the outside squares of the netting, the latter version consisted of a length of 5 cm webbing sewn onto the edge of the netting, with D-rings attached to this webbing using small 2.54 cm pieces of webbing A rigid frame, roughly 4 m square, was constructed from 10 cm angle iron to support the test samples. 2.5 cm eye bolts were attached to the inside corners and at the centres of each side of the frame. A 0.6 cm cable was strung through the eye bolts and tightened with a turnbuckle. The netting was attached to this cable by stringing a rope between the edge attachment system and the cable every foot or so along the perimeter of the sample.

The degree to which the test specimen was stretched into place depended on the type of edge attachment—the webbing allowed for very little stretch, whereas the rope strung through the edge allowed for ample pre-stressing (approximately 13.7%).

The projectile used was a steel cylinder roughly 9 cm diameter, roughly 20 cm long, and 11.7 kg weight. As the projectile had fairly sharp edges, tape was placed around the bottom edge to avoid cutting the test specimen. A ring was attached to the top of the weight to support it from the crane.

Experimental Procedure

The hook of a crane was placed above the centre of the net. A rope was strung through the hook and attached to the projectile. A tape measure attached to the hook was used to measure the height of the projective above the net. The projectile was dropped from increasing heights until the net failed. A video camera recorded all tests, and was used to measure displacement of the net, as indicated by a scale on the far side of the frame.

Results

The maximum height from which a projectile could be dropped without damaging the net ranged from 9.3 m (for the pre-stretched sample) to 10.21 m (for the unstretched sample), which corresponds to an impact energy of 1100 to 1200 Joules. The maximum displacement of the pre-stretched sample was approximately 1.0 m whereas the maximum displacement of the unstretched sample was approximately 1.3 m. The holes left by impacts from a greater height were typically 20 cm in diameter. The force of impact was sufficient to do significant damage to the corner eyebolts. After the series of roughly 15 tests, the eyes had been forced open, leaving gaps as large as 2 cm.

The nets were tested to failure. After the first intentional failure of the netting, several subsequent drop tests were performed on the netting. Results from these tests and direct observations indicate that damage to the net was limited to the immediate vicinity of the actual hole; outside a small distance (15 cm) away from the hole, the net performed as well as it had before being damaged.

(B) Comparative drop tests were conducted with approximately 1.25 m×1.25 m samples of netting formed of various materials in various notted, knitted or raschel construction. The samples were attached by webbing and D-rings to the frame as outlined under A. The same test weight iron cylinder (11.8 kg) of 9 cm diameter was dropped from various heights until the net was penetrated.

The following materials were tested.

Sample

1. White polypropylene monofilament knit netting. Mesh size 1.5×4 mm. Roughly 50% open. From Roxford Fordell.
2. Black polyethylene monofilament and tape simple weave shade cloth. Mesh size 2.3 mm. 60% open.
3. Orange polypropylene multifilament knotted netting. Mesh size 1⅜" (stretched mesh). Roughly 80% open. Redden 210/27.
4. Black nylon multifilament raschel knit netting. Mesh size 2" (stretched mesh). Roughly 85% open. Redden 210/42.
5. White polyester (high tenacity) multifilament knit netting. Mesh size 1.5×3 mm. Roughly 25% open. Much more fibre in one direction. Tek-knit 2059.
6. White nylon multifilament knotted netting. 3½" stretched mesh. Roughly 90% open. First Washington Net #18 nylon.
7. Black nylon multifilament knotted netting. 1⅞" stretched mesh. Roughly 90% open. From First Washington Net.
8. White nylon multifilament raschel knit netting. ½" stretched mesh. Roughly 70% open. Hafner 210/20.

The results are shown in Table 5, wherein areal density means the weight per unit area of net and the maximum impact energy is the maximum impact energy without failure.

TABLE 5

Mesh Areal Densities and Impact Resistance
Impact energies stated are the maximum impact energies without net failure

| Material | Areal Density | Areal Density lb/ft$^2$ | Maximum Impact Energy (J) | Maximum Impact Energy (ft-lb) | Energy Capacity (Jcm$^2$/g) |
|---|---|---|---|---|---|
| 1 | 0.0212 | 4.34 | 197 | 131 | 844 |
| 2 | 0.00967 | 1.98 | undetermined | undetermined | — |
| 3 | 0.258 | 52.8 | 429 | 315 | 1663 |
| 4 | 0.122 | 24.9 | 107 | 79 | 877 |
| 5 | 0.469 | 96.0 | 1286 | 946 | 2742 |
| 6 | 0.0659 | 13.5 | 71 | 53 | 1077 |
| 7 | 0.544 | 111 | 143 | 105 | 2629 |
| 8 | 0.221 | 45.2 | 643 | 473 | 2910 |

Note: 2 failed at the edges (weave pulled apart).

Maximum Impact Energy is the maximum kinetic energy of the projectile as it strikes the net, without failure of the net during that particular test. It is calculated by multiplying projectile mass×gravitational acceleration×height of drop. Units are kgm$^2$/s$^2$=Joules (J), or ft-lb. These data apply to this set of tests only: 11.95 kg (26.3) lb), 3½" diameter cylindrical projectile, striking a 1.25 square test specimen.

Energy Capacity is the maximum impact energy absorbable by a particular netting sample, compensated for the density of the sample. This enables comparisons of netting configurations to be made as if all had equal areal density. Energy capacity is calculated by dividing the Maximum Impact Energy by the Areal Density. Units are Jm^2/kg (or ft-lb/(lb/fit^2)). As with Maximum Impact Energy, these data apply only to the given test conditions.

Table 5 shows that to protect a given area with a given weight of material, the decreasing order of preference of the materials is No.8, No.5, No.7. Although Specimen No.8, 210/20 raschel nylon, performed best, other materials may be superior when modified to make them better suited to the application.

Specimen 5, for example, is much stronger in having more fibres in one direction than the other. It would likely have improved performance if strength was more equal in the warp and weft directions. The directional difference in strengths led to a "tear" type of failure, rather than the usual "punch-through" failure. Also, No.7 would probably perform better with a smaller mesh size, allowing the impacter to strike more twines in the mesh.

It will be readily understood in the art that very many varieties of knits are possible and which may be considered if the material selected has the desired high degree of stretch, high strength and high initial stiffness. Alternative monofilament construction rather than multifilament offers acceptable efficacy in being cheaper to manufacture while being only 20% weaker. It will be realised that for a given areal density of fabric netting, a smaller mesh size allows of greater impact resistance.

3. Air Cannon Tests

Impact tests were performed using a standardised air-propelled wood projectile at American Test Laboratory in Pompano Beach, Fla., U.S.A., to simulate hurricane force winds-windborne debris.

Apparatus

Similar netting—Nylon 6,6 raschel knit, was used for this test as in the previous drop-tests. The edge attachment system used was a 5 cm webbing sewn around the edge of the samples, with D-rings attached with 2.54 cm webbing, spaced roughly 30 cm apart.

A bolted wooden frame of approximately 4 m square was used as part of the restraining means. 1.3 cm eye bolts were mounted through the wood at each corner of the frame and in the centres of the sides. A 0.6 cm cable was strung through the eye bolts and tightened with a turnbuckle. Rope was used to attach the D-rings to the cable. Tension in the netting was low.

The cannon used to propel the projectile consisted of an air compressor, an air reservoir with a pressure gauge, a 10 cm air line, a manually activated butterfly valve, and a 10 cm PVC tube as a barrel of the cannon. The end of the cannon was approximately 7.5 m from the flat, vertical stationary plane of net.

The projectile was a 4 kg, 5 cm×10 cm×2.4 m Southern Pine member having its front end slightly rounded. A 10 cm diameter disc was attached to the back end to provide a pressure seal for the barrel of the air cannon.

Procedure

Four tests were performed at increasing speeds: 65, 80, 90, and 100 feet per second (fps). Speed had been previously calibrated to reservoir pressure at pressures up to 80 fps, and an extrapolation was made from this data to calculate the pressure required to provide the higher speeds. The tests were recorded on videotape and also provided the displacement of the netting during impact.

Results

The net withstood the impact of the 5 cm×10 cm×2.4 m rectangular wood projective at the aforesaid selected three speeds of up to 90 fps, with net deformation from its flat stationary plane of up to 1.1 m. At 100 fps, the net failed, leaving a 33 cm×30 cm rectangular hole. Surprisingly, the eyebolts in each of the comers of the frame showed significant alteration in that their eyes had been pried open and the bolt shanks bent by as much as 15 degrees. This indicated that the cumulative force of impacts of the four speeds had been significantly large and had been transferred through the net material to each of the bolts. It should also be noted that the 90 fps test success indicates that the net is capable of withstanding more than three times the energy of the standard impact test of 50 fps.

Similar air cannon impact tests with the 5 cm×10 cm×2.4 m wood member conducted on 1.5 cm thick plywood and on 6 mm thick tempered and heat strengthened glass produced penetration of the plywood and breakage of the glass at 50 fps.

The degree of resiliency of the material element of the net was measured for two netting configurations: 210/20 nylon, and 18/80 polypropylene raschel. Maximum elongation for the nylon was roughly 34%, whereas the polypropylene stretched as much as 50%. Tests showed that in one test an impact energy of approximately 800 joules on the above nylon 210/20 netting was readily absorbed by the net system while providing a displacement of approximately 0.7 m. A 18/18 polypropylene net of 65% of the areal weight of nylon 210/20 also withstood the same impact of the wooden member at 20 m/s and provided a deformation of approximately 1 m.

Although the disclosure describes and illustrates preferred embodiments of the invention, it is to be understood that the invention is not limited to these particular embodiments. Many variations and modifications will now occur to those skilled in the art.

I claim:

1. Apparatus for shielding, anchoring and containing a trailer or mobile home in the event of gale-force winds, the trailer or mobile home having a roof and outer side walls, the apparatus comprising;

a substantially wind-permeable perforate sheet means of a resiliently flexible material having a surface area substantially greater than a combined surface area of a roof and the outer side walls of a mobile home and adapted for placement over the roof and extendable downwardly and outwardly from said roof at an acute angle to said outer side walls of said home, said sheet means being constructed and arranged to deflect or restrain windborne debris having an impact energy sufficient to damage said home by distribution of the impact energy throughout said material when the debris contacts the material;

a plurality of ground anchor members adapted for placement in the ground surrounding said home; and attachment means, attachable to said perforate sheet means along a periphery thereof, for securing said perforate sheet means to ground anchor members thereby anchoring said home to the ground, wherein said sheet means comprises a generally rectangular central sheet; opposing end sheets; and opposing side sheets, said end sheets and said side sheets being coupled to a periphery of said central sheet and each of said end sheets being coupled to an adjacent side sheet, said central portion being sized to correspond generally to the roof of said home and said side sheets and said end sheets being sized to extend downwardly and outwardly from said central portion at an acute angle to the outer side walls of said home.

2. Apparatus for shielding, anchoring and containing a trailer or mobile home in the event of gale-force winds, the trailer or mobile home having a roof and outer side walls, the apparatus comprising:

a substantially wind-permeable perforate sheet means of a resiliently flexible material having a surface area substantially greater than the combined surface area of the roof and the outer side walls of said home and adapted for placement over the roof and extendable downwardly and outwardly from said roof at an acute angle to said outer side walls of said home, said sheet means being constructed and arranged to deflect or restrain windborne debris having an impact energy sufficient to damage said home by distribution of the impact energy throughout said material when the debris contacts the material;

a plurality of ground anchor members adapted for placement in the ground surrounding said home; and attachment means, attachable to said perforate sheet means along a periphery thereof, for securing said perforate sheet means to ground anchor members thereby anchoring said home to the ground, wherein said sheet means comprises a central portion, defined by a generally rectangular strip member such that said central portion has an opening therein; opposing end sheets; and opposing side sheets, said end sheets and said side sheets being coupled to a periphery of said strip member and each of said end sheets being coupled to an adjacent side sheet, said central portion being sized to correspond generally to the roof of said home and said side sheets and said end sheets being sized to extend downwardly and outwardly from said central portion at an acute angle to the outer sidewalls of said home.

3. The apparatus according to claim 1, wherein said sheet means is constructed and arranged to withstand an impact energy of at least 500 Joules.

4. The apparatus according to claim 2, wherein said sheet means is constructed and arranged to withstand an impact energy of at least 500 Joules.

* * * * *